US011501663B2

(12) United States Patent
Petru et al.

(10) Patent No.: US 11,501,663 B2
(45) Date of Patent: Nov. 15, 2022

(54) METHOD AND APPARATUS FOR ASSISTING IN THE ORGANIZATION OF PAIRED ITEMS

(71) Applicant: PAIRURSOCKS, LLC, Houston, TX (US)

(72) Inventors: Gregory J. Petru, Cypress, TX (US); Richard L. Petru, Cypress, TX (US); Timothy M. Petru, Cypress, TX (US)

(73) Assignee: PAIRURSOCKS, LLC, Houston, TX (US)

( * ) Notice: Subject to any disclaimer, the term of this patent is extended or adjusted under 35 U.S.C. 154(b) by 0 days.

(21) Appl. No.: 15/417,073

(22) Filed: Jan. 26, 2017

(65) Prior Publication Data

US 2017/0221389 A1 Aug. 3, 2017

Related U.S. Application Data

(60) Provisional application No. 62/288,688, filed on Jan. 29, 2016.

(51) Int. Cl.

| | |
|---|---|
| ***G09F 3/02*** | (2006.01) |
| ***B65D 67/02*** | (2006.01) |
| ***G09F 3/04*** | (2006.01) |
| ***A41B 11/00*** | (2006.01) |

(52) U.S. Cl.

CPC ..... *G09F 3/02* (2013.01); *A41B 11/002* (2013.01); *B65D 67/02* (2013.01); *G09F 3/04* (2013.01); *G09F 2003/0282* (2013.01)

(58) Field of Classification Search

CPC ... A44B 99/00; G09F 3/00; G09F 3/02; G09F 3/04; G09F 2003/0282; A01K 11/001; A41B 11/002; Y10S 24/29; Y10T 24/366; Y10T 24/3683; Y10T 24/45571; Y10T 24/45776; Y10T 24/45042; A44D 2201/06; B65D 67/02

See application file for complete search history.

(56) References Cited

U.S. PATENT DOCUMENTS

| | | | | | |
|---|---|---|---|---|---|
| 2,863,197 | A * | 12/1958 | Statham | A44B 1/28 | 24/114.4 |
| 3,699,617 | A * | 10/1972 | Hofmeister | A44B 99/00 | 24/341 |
| 3,729,780 | A * | 5/1973 | White | A44B 99/00 | 24/704.2 |

(Continued)

*Primary Examiner* — Cassandra Davis
(74) *Attorney, Agent, or Firm* — Williams Morgan, P.C.

(57) ABSTRACT

A tag useful for being applied to a first item, such as a sock, as an indication that the item is intended to be used with a second tagged item, such as a matching sock in a pair of socks. The tag has a first end portion, a second end portion, a flexible intermediate portion extending between the first and second end portions, and a latching mechanism. The flexible intermediate portion is movable between first and second operative positions wherein the first and second end portions are spaced apart in the first operative position and are adjacent in the second operative position. The latching mechanism is coupled to the first and second portions and is adapted to maintain the first and second end portions in the second operative position. In one embodiment, the tag is clipped and latched onto a sock in the second operative position.

14 Claims, 3 Drawing Sheets

(56) References Cited

U.S. PATENT DOCUMENTS

| | | | | | |
|---|---|---|---|---|---|
| 4,198,772 | A * | 4/1980 | Furutu | G09F 3/00 | 292/318 |
| 4,387,488 | A * | 6/1983 | Kanzaka | A44B 1/12 | 24/108 |
| 4,457,050 | A * | 7/1984 | Kanzaka | A44B 1/34 | 24/108 |
| 4,536,924 | A * | 8/1985 | Willoughby | A44B 99/00 | 24/487 |
| 6,032,294 | A * | 3/2000 | Dean | A41B 11/002 | 2/239 |
| 6,092,241 | A * | 7/2000 | Bellet | A41B 11/002 | 2/239 |
| 6,266,853 | B1 * | 7/2001 | Ho | A44B 1/28 | 24/105 |
| 6,299,039 | B1 * | 10/2001 | Hsu | A47F 5/0006 | 223/85 |
| 6,463,636 | B1 * | 10/2002 | Friedewald | A41B 11/002 | 24/2 |
| 8,701,317 | B2 * | 4/2014 | Le Devehat | A01K 11/001 | 40/302 |
| 2003/0000119 | A1 * | 1/2003 | Savy | A01K 11/001 | 40/301 |

* cited by examiner

METHOD AND APPARATUS FOR ASSISTING IN THE ORGANIZATION OF PAIRED ITEMS

BACKGROUND OF THE INVENTION

Field of the Invention

Generally, the present disclosure relates to the organization of paired items, and, more specifically, to various methods and structures for identifying items that are to be utilized in pairs, such as socks.

Description of the Related Art

In the field of clothing, it is not unusual for certain items to be sold and maintained in pairs or sets, often matching, and intended to be used or worn together, such as socks or hosiery. During the process of cleaning and maintaining these items, it is commonplace that the pairing is often disturbed and at some point must be reestablished. Of course, the correct pairings may, in some circumstances, be difficult to ascertain. For example, finding precisely matching socks in the dim early morning light of a closet has been a challenge to the most fashion conscious. Many a natty dresser has arrived at the office only to discover that he/she is wearing unmatched hosiery, such as one black sock and one blue sock.

The present disclosure may address and/or at least reduce one or more of the problems identified above.

SUMMARY OF THE INVENTION

The following presents a simplified summary of the invention in order to provide a basic understanding of some aspects of the invention. This summary is not an exhaustive overview of the invention. It is not intended to identify key or critical elements of the invention, or to delineate the scope of the invention. Its sole purpose is to present some concepts in a simplified form as a prelude to the more detailed description that is discussed later.

Generally, the present disclosure is directed to a tag useful for being applied to a first item as an indication that the item is intended to be used with a second tagged item. The tag includes a first and second end portion, a flexible intermediate portion extending between the first and second end portions, and a latching mechanism. The first end portion has a label. The flexible intermediate portion is movable between first and second operative positions wherein the first and second end portions are spaced apart in the first operative position and are adjacent in the second operative position. The latching mechanism is coupled to the first and second portions and is adapted to maintain the first and second end portions in the second operative position.

BRIEF DESCRIPTION OF THE DRAWINGS

The disclosure may be understood by reference to the following description taken in conjunction with the accompanying drawings, in which like reference numerals identify like elements, and in which.

Figure 1A:
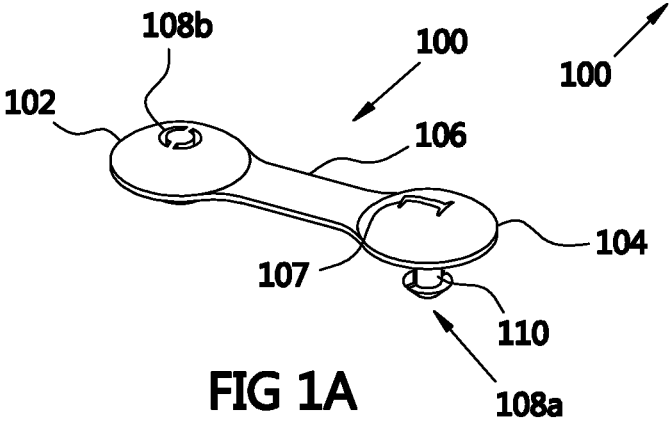
FIGS. 1A-1B illustrate a stylized depiction of a first embodiment of a tag in a first operational orientation.

While the subject matter disclosed herein is susceptible to various modifications and alternative forms, specific embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

DETAILED DESCRIPTION

Various illustrative embodiments of the invention are described below. In the interest of clarity, not all features of an actual implementation are described in this specification. It will, of course be appreciated, that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would, nevertheless, be a routine undertaking for those of ordinary skill in the art having the benefit of this disclosure.

The present subject matter will now be described with reference to the attached figures. Various structures, systems and devices are schematically depicted in the drawings for purposes of explanation only and so as to not obscure the present disclosure with details that are well known to those skilled in the art. Nevertheless, the attached drawings are included to describe and explain illustrative examples of the present disclosure. The words and phrases used herein should be understood and interpreted to have a meaning consistent with the understanding of those words and phrases by those skilled in the relevant art. No special definition of a term or phrase, i.e., a definition that is different from the ordinary and customary meaning as understood by those skilled in the art, is intended to be implied by consistent usage of the term or phrase herein. To the extent that a term or phrase is intended to have a special meaning, i.e., a meaning other than that understood by skilled artisans, such a special definition will be expressly set forth in the specification in a definitional manner that directly and unequivocally provides the special definition for the term or phrase.

Embodiments herein are directed to devices (e.g., tags) that may be applied to various paired items to indicate that they belong together, or at least are intended to be used together. In general, a tag may be placed on each item in a set of items and may include a readily recognizable identifier that indicates a proper pairing. Thus, in the dim early morning light of a closet, a user need not recognize the subtle difference between dark blue and black socks, for example, but rather, can rely on the more easily recognized identifiers on the tags to establish the desired item/items. Additionally, the tags may be used to assist in the separating and sorting of clean laundry. Further, the tags may be particularly useful to individuals who have color blindness or color vision deficiency, as their acuity to color differences may be limited. Color blind individuals may use the tags the identify clothing items of a particular color. For example, color blind individuals may use the tags to identify any clothing item of a particular color. In some applications, the color blind individual may elect to place the same tag, such as a tag with an identifier 1 on it, on all black items, including for example socks, pants, shirts, coats, etc., and a different tag, such as a tag with an identifier 2 on it, on differently colored items, such as blue socks, pants, shirts, coats, etc.

FIG. 1A illustrates a perspective view of one embodiment of a tag 100 that may be applied to pairs of clothing items to associate like items. For example, the tags 100 may be applied to each like sock of a pair of socks. The tag 100 includes first and second end portions 102, 104 and a flexible intermediate portion 106 extending therebetween. The first end portion 102 may include a label 107, such as one or more alphanumeric characters (0-9, a-z, etc.) or other symbols, such as princess crowns, chess pieces, mah Jong pieces, etc., such that alike clothing items may be labeled identically. For example, it may be useful to apply tags 100 to all matching black, single socks with the label "1," so that should a pair of black socks be separated, that may be readily reassembled as a pair of black socks by identifying the appropriate label "1," even in less than ideal lighting conditions. The labels may also be useful in identifying the desired color of the sock. For example, should a pair of black socks be needed to match a desired outfit, they may be quickly and accurately located in a drawer of mixed color socks by simply locating the correct label. Those skilled in the art will appreciate that the tags 100 may also be labeled with braille symbols to assist individuals with impaired vision.

Figure 1B:
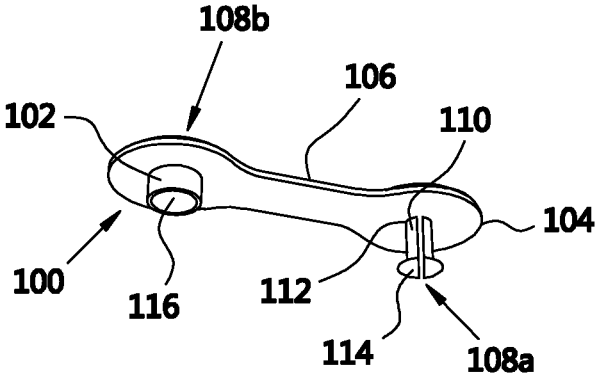
Figure 2A:
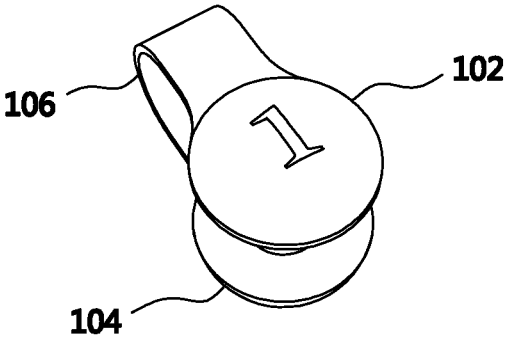
FIGS. 2A-2C illustrate a stylized depiction of the first embodiment of the tag in a second operational orientation.
Figure 2B:
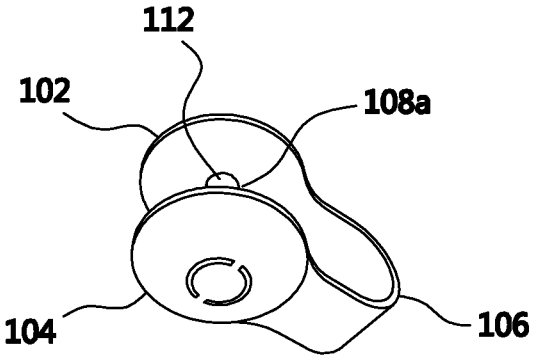
Figure 2C:
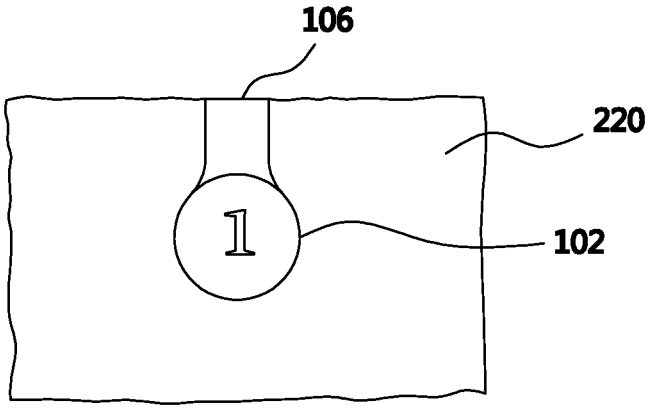

The flexible intermediate portion 106 extends between the first and second end portions 102, 104, and is movable between first and second operative positions wherein the first and second end portions 102, 104 are spaced apart in the first operative position (as shown in FIGS. 1A-1B) and are adjacent in the second operative position (as shown in FIGS. 2A-2B). During installation of the tag 100 on an article of clothing, such as a sock 220, the flexible intermediate portion 106 may be bent over the top edge of the sock 220 (see FIG. 2C), bringing the first and second end portions 102, 104 near each other on opposite sides of the sock. Thereafter, the tag 100 is maintained in this position by a latching mechanism 108*a*, 108*b*.

The latching mechanism 108*a*, 108*b* is coupled to the first and second portions 102, 104 and is adapted to maintain the first and second end portions 102, 104 in the second operative position. The latching mechanism 108*a* may take any of a variety of forms, and in one embodiment, includes a tubular portion 110 having a proximal end 112 attached to the second end portion 104 and a distal end 114 with an enlarged deformable head. In one embodiment, the latching mechanism 108*a* may be split longitudinally to facilitate the latching action of the latching mechanism 108*a*, 108*b*.

The latching mechanism 108*b* includes an opening 116 adapted to receive and retain the enlarged deformable head of the distal end 114 of the latching mechanism 108*a* to securely couple the end portions 102, 104 together. The tubular portion 110 of the latching mechanism 108*a* is designed to pass through the fabric of the sock 220, either through a preformed hole or through natural spaces in the woven material. In this way, the tag 100 is secured to the sock 220 and is not easily dislodged or lost, but rather, is securely retained to avoid loss or inadvertent removal of the tag 100 during normal use and laundering.

Figure 3A:
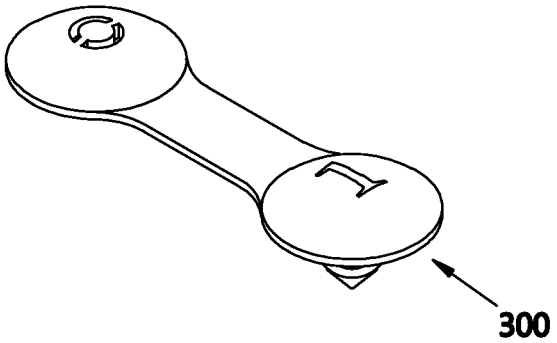
FIGS. 3A-3D illustrate a stylized depiction of a second embodiment of a tag in a first operational orientation.
Figure 3B:
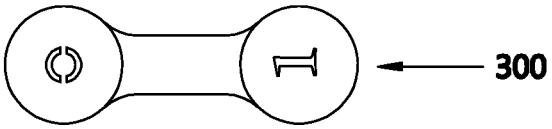
Figure 3C:
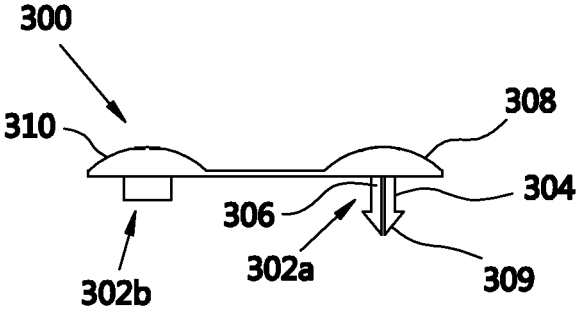
Figure 3D:
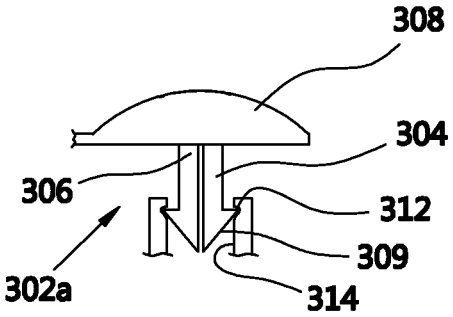

Turning now to FIGS. 3A-3D, an alternative embodiment of a tag 300 is shown. In this embodiment, the tag 300 is similar to the tag 100, differing mainly in the shape of the locking mechanism 302*a*, 302*b*. The locking mechanism 302*a* includes a tubular portion 304 with a proximal end 306 attached to a second end portion 308 of the tag 300 and a distal end 309 with an enlarged deformable head that has a pointed cross sectional configuration that engages with and is retained by the locking mechanism 302*b* on the first end portion 310 of the tag 300. The pointed cross sectional configuration is useful in that is allows the locking mechanism 302*a* to more readily pass through the material of the sock during the installation process. In one embodiment, the locking mechanism 302*a* may be rendered readily deformable by forming the locking mechanism from two symmetrical halves that are split or separated longitudinally by a relatively small space. Accordingly, when the split locking mechanism 302*a* is inserted into the tubular locking mechanism 302*b*, the symmetrically halves of the split locking mechanism 302*a* are compressed together owing to the tubular locking mechanism 302*b* having an opening 314 with a slightly smaller internal diameter than the outer dimension of the split locking mechanism 302*a*. Additionally, as is seen in FIG. 3D, one or more barbs 312 extend radially from the split locking mechanism 302*a* and operate to "dig into" or deformably engage the interior surface of the opening 314 of the tubular locking mechanism 302*b*. In this way, the locking mechanism 302*a*, 302*b* is securely coupled together and is less likely to become disengaged during normal use and laundering of the paired items (e.g., socks). The locking mechanism 302 may be formed from a plastic material that is deformable to receive the larger diameter barbs 312 therein.

Figure 4:
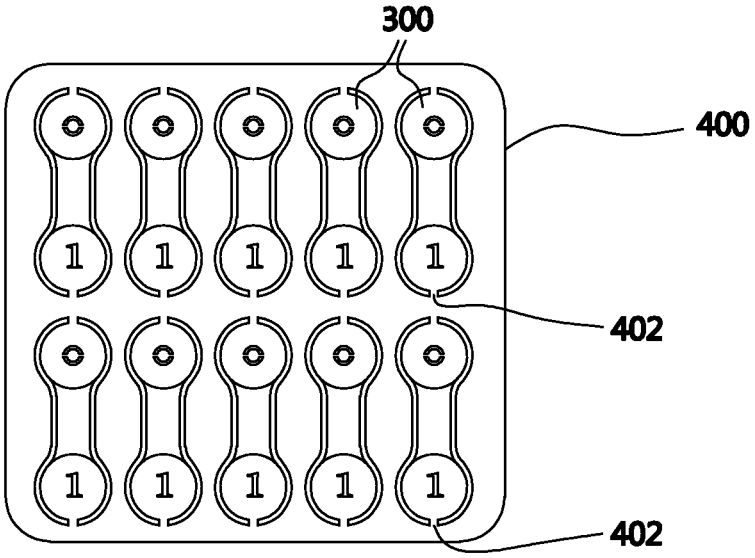
FIG. 4 illustrates a collection of tags of the type shown in FIGS. 1-3 in a shipping or sales configuration.

Turning now to FIG. 4, one embodiment of a mechanism for manufacturing, packaging, and distributing the tags 300 is shown. In this embodiment a card 400 is formed using an injection molding process. The card 400 includes a plurality of the tags 300 formed therewith, but attached thereto by only very small nibs 402. The nibs 402 have a thickness that insures that the tags 300 are coupled to the card 400 and may not be inadvertently dislodged from the card 400, but are sufficiently thin to allow a user to easily break them and remove the desired tag 300 for installation on the desired item of clothing. Alternatively, it may be desirable to remove the tags 300 from the card 400 prior to packaging and sale to the customer. That is the actual configuration of the salable item may be a series of packages of loose tags 300, where each set of tags 300 having like symbols are separately packaged. For example, all of the tags 300 bearing the 1 labels may be located in one package, all of the tags 300 bearing the 2 labels may be located in a second package, and so forth.

Figure 5A:
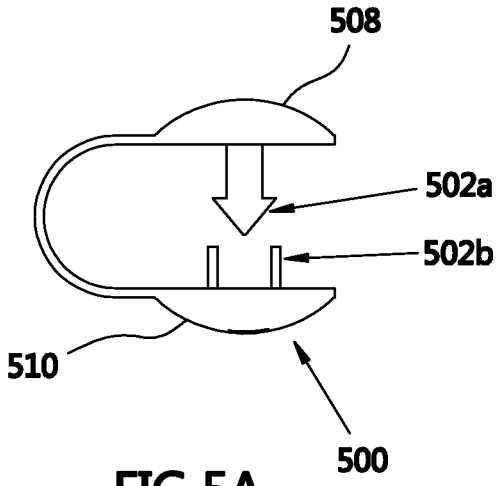
FIGS. 5A-5C illustrate a series of side-views of an alternative embodiment in which the tag is manipulated between an unsecured and a secured orientation.
Figure 5B:
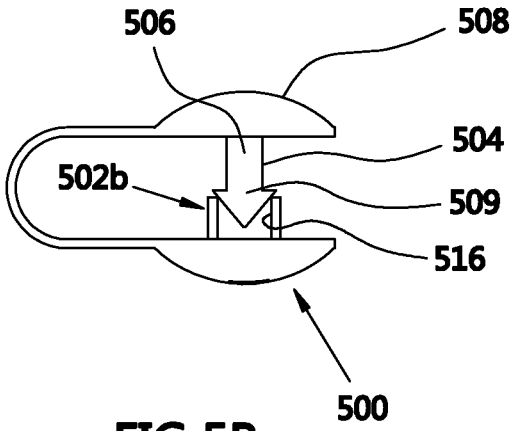
Figure 5C:
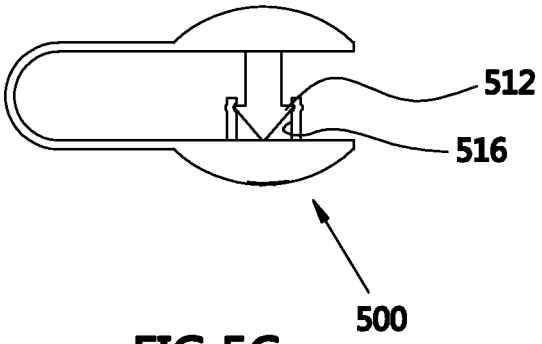

Turning now to FIGS. 5A-5C, an alternative embodiment of a tag 500 is shown. In this embodiment, the tag 500 is similar to the tags 100, 300, differing mainly in the shape of the locking mechanism 502*a*, 502*b*. The locking mechanism 502*a* includes a tubular portion 504 with a proximal end 506 attached to a second end portion 508 of the tag 500 and a distal end 509 with an enlarged deformable head that has a pointed cross sectional configuration that engages with and is retained by the locking mechanism 502*b* on the first end portion 510 of the tag 500. The pointed cross sectional configuration is useful in that it allows the locking mechanism 502*a* to more readily pass through the material of the sock during the installation process. In this embodiment, unlike the embodiment shown in FIGS. 3A-3D, the locking mechanism 502*a* is a relatively solid configuration and is not formed from two symmetrical halves that are split or separated longitudinally by a relatively small space. Accordingly, when the solid locking mechanism 502*a* is inserted into the tubular locking mechanism 502*b*, barbs 512 on the solid locking mechanism 502*a* press firmly against an inner surface 516 of the tubular locking mechanism 502*b* and operate to "dig into" or deformably engage the inner surface 516 of the tubular locking mechanism 502*b*. In this way, the locking mechanism 502*a*, 502*b* is securely coupled together and is less likely to become disengaged during normal use and laundering of the paired items (e.g., socks).

The particular embodiments disclosed above are illustrative only, as the invention may be modified and practiced in different but equivalent manners apparent to those skilled in the art having the benefit of the teachings herein. For example, the process steps set forth above may be performed in a different order. Furthermore, no limitations are intended to the details of construction or design herein shown, other than as described in the claims below. It is, therefore, evident that the particular embodiments disclosed above may be altered or modified and all such variations are considered within the scope and spirit of the invention. Accordingly, the protection sought herein is as set forth in the claims below.

What is claimed is:

1. A tag useful for being applied to a first item as an indication that the item is intended to be used with a second similarly tagged item, comprising:

a first end portion having a label;

a second end portion;

a flexible intermediate portion extending between the first and second end portions, and being movable between first and second operative positions wherein the first and second end portions are spaced apart in the first operative position and are adjacent in the second operative position; and a latching mechanism coupled to the first and second portions and adapted to lock the first and second end portions in the second operative position, the latching mechanism being configured to pass through an opening in the first item with the latching mechanism being in the second operative position, the latching mechanism further comprises:

a male portion attached to the first end portion, the male portion includes a proximal end portion attached to the first end portion, and a head at a distal end portion; and a female portion attached to the second end portion, the female portion includes a tubular shaped body having a uniform inner diameter opening at a distal end to receive at least a portion of the head therein, wherein the head has at least one barb extending from an outer circumference thereof with the barb extending in a radial direction to a distance greater than the inner diameter of the tubular shaped body to deform and engage the inner surface of the tubular shaped body of the female portion of the latching mechanism to lock the male and female portions of the latching mechanism together in the second operative position.

2. A tag, as set forth in in claim 1, wherein the head has a pointed cross section.

3. A tag, as set forth in in claim 1, wherein the label includes an alphanumeric character.

4. A tag, as set forth in in claim 1, wherein the label includes a braille symbol.

5. A system for identifying items to be used together, comprising:

a first and second item of clothing;

a first and second tag applied to the first and second item of clothing, respectively;

each of the first and second tags having:

a first end portion having a label;

a second end portion;

a flexible intermediate portion extending between the first and second end portions, and being movable between first and second operative positions wherein the first and second end portions are spaced apart in the first operative position and are adjacent in the second operative position; and a latching mechanism coupled to the first and second portions and adapted to lock the first and second end portions in the second operative position, said latching mechanism having:

a male portion having a proximal end portion attached to the first end portion, and a head at a distal end portion the male portion passing through an opening in the item of clothing with the latching mechanism being in the second operative position, a female portion attached to the second end portion, the female portion includes a tubular shaped body having a uniform inner diameter opening at a distal end to receive at least a portion of the head therein, wherein the head has at least one barb extending from an outer circumference thereof with the barb extending in a radial direction to a distance greater than the inner diameter of the tubular shaped body to deform and engage the inner surface of the tubular shaped body of the female portion of the latching mechanism to lock the male and female portions of the latching mechanism together in the second operative position.

6. A tag, as set forth in in claim 5, wherein the head has a pointed cross section.

7. A tag, as set forth in in claim 5, wherein the label includes an alphanumeric character.

8. A tag, as set forth in in claim 5, wherein the label includes a braille symbol.

9. A tag useful for being applied to a first item as an indication that the item is intended to be used with a second similarly tagged item, comprising:

a first end portion have a label;

a second end portion;

a flexible intermediate portion extending between the first and second end portions, and being movable between first and second operative positions wherein the first and second end portions are spaced apart in the first operative position and are adjacent in the second operative position; and a latching mechanism coupled to the first and second portions and adapted to lock the first and second end portions in the second operative position, said latching mechanism having a male portion attached to the first end portion, and a female portion attached to the second end portion, wherein the male portion includes a proximal end portion attached to the first end portion, and a head at a distal end portion, and the female portion includes a tubular shaped body having a uniform inner diameter opening at a distal end to receive at least a portion of the head therein, the head having a pointed cross section to facilitate the male portion passing through an opening in the first item with the latching mechanism being in the second operative position, the head having at least one barb extending from an outer circumference thereof and having a width greater than the opening in the female portion with the barb extending in a radial direction to a distance greater than the inner diameter of the tubular shaped body to deform and engage the inner surface of the tubular shaped body of the female portion of the latching mechanism to lock the male and female portions of the latching mechanism together in the second operative position.

10. A tag, as set forth in in claim 9, wherein the label includes an alphanumeric character.

11. A tag, as set forth in in claim 9, wherein the label includes a braille symbol.

12. A system, comprising:

an item of clothing, and a tag coupled to the item of clothing, having:

a first end portion having a label;

a second end portion;

a flexible intermediate portion extending between the first and second end portions, and being movable between first and second operative positions wherein the first and second end portions are spaced apart in the first operative position and are adjacent in the second operative position; and a latching mechanism coupled to the first and second portions and configured to lock the first and second end portions in the second operative position, the latching mechanism passing through an opening in the item of clothing with the latching mechanism being in the second operative position, the latching mechanism further comprises:

a male portion attached to the first end portion, the male portion includes a proximal end portion attached to the first end portion, and a head at a distal end portion; and a female portion attached to the second end portion, the female portion includes a tubular shaped body having a uniform inner diameter opening at a distal end to receive at least a portion of the head therein, wherein the head has at least one barb extending from an outer circumference thereof with the barb extending in a radial direction to a distance greater than the inner diameter of the tubular shaped body to deform and engage the inner surface of the tubular shaped body of the female portion of the latching mechanism to lock the male and female portions of the latching mechanism together in the second operative position.

13. A tag, as set forth in in claim 12, wherein the label includes an alphanumeric character.

14. A tag, as set forth in in claim 12, wherein the label includes a braille symbol.

* * * * *